US006452582B1

(12) United States Patent
Rolston

(10) Patent No.: US 6,452,582 B1
(45) Date of Patent: Sep. 17, 2002

(54) METHOD AND APPARATUS FOR REFRESHING A LIQUID CRYSTAL DISPLAY

(75) Inventor: Walter Rolston, Overland Park, KS (US)

(73) Assignee: Garmin Corporation (TW)

( * ) Notice: Subject to any disclaimer, the term of this patent is extended or adjusted under 35 U.S.C. 154(b) by 0 days.

(21) Appl. No.: 09/452,598

(22) Filed: Dec. 1, 1999

(51) Int. Cl.[7] ..... G09G 3/36
(52) U.S. Cl. ..... 345/102; 345/211; 345/87
(58) Field of Search ..... 345/87, 88, 89, 345/94, 95, 96, 97, 98, 99, 100, 102, 690, 691, 211, 212, 213, 214

(56) References Cited

U.S. PATENT DOCUMENTS 5,337,068 A * 8/1994 Stewart et al. ..... 345/102
5,815,228 A * 9/1998 Flynn ..... 345/102
5,844,540 A * 12/1998 Terasaki ..... 345/102
5,977,942 A * 11/1999 Walker et al. ..... 345/102

* cited by examiner

*Primary Examiner*—Xiao Wu
(74) *Attorney, Agent, or Firm*—Devon A. Rolf

(57) ABSTRACT

A method and apparatus for refreshing a passive liquid crystal display. A device implements a liquid crystal display, having a liquid crystal module, a backlight, a processor, and controllers. The processor establishes a first frequency for the backlight to provide dimming ratios greater than 20 to 1. The processor establishes a second frequency for refreshing the LCD module such that the ratio of the display refresh frequency to backlight frequency is 6.5. The multiplicative and fractional factor reduces display aliases and beat frequency artifacts created by the differences in the two frequencies.

31 Claims, 5 Drawing Sheets

METHOD AND APPARATUS FOR REFRESHING A LIQUID CRYSTAL DISPLAY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to a method and apparatus for refreshing a display that uses an internally controlled backlight. More particularly, the present invention is directed to a passive liquid crystal display with light source that is used in a front, edge or backlight configuration that has a wide dimming range while minimizing display artifacts caused by beating of display refresh and backlight signals.

Conventional liquid crystal displays have been known in the art for displaying information in a variety of applications. These include electronic instrumentation, calculator displays, and the like. Avionics instrumentation frequently uses a variety of LCD displays to provide information in the cockpit. In certain scenarios, especially in dark conditions outside the cockpit, LCD displays become overly bright and the pilot wishes to dim the LCD displays to allow his/her eyes to adjust to the outside conditions.

LCD displays utilize non-emitting pixels (liquid crystals) and therefore require a light source. Some LCDs are of a reflecting type and use either an external source such as the sun, or an internal front lighting source. Some LCDs are transmissive only and require an internal light source. Some LCDs are trans-reflective which use both reflective and transmissive modes. Possible light sources include cold cathode flourescent tubes, hot cathode flourescent tubes, LEDs, and Electroluminescents.

To provide dimming of the display, the light source intensity and/or light source "on time" can be controlled. When the intensity method is used, typically, the amount of current used in the light source is varied. Typically this method does not yield a large dimming ratio because of the non-linear relationship of current to light and the difficulty for some technologies to know when light is being produced. Light source "on time" controls brightness by only having the display on a certain amount of time for each backlight period. This method will be referred to as the duty cycle method. Typically the backlight period is greater than 60 Hz. The aspects and features of the present invention are most useful with the duty cycle method of dimming. Note that this flashing on and off of the light source typically allows much wider dimming ranges and also causes the source to behave like a strobe light.

Passive LCD pixels begin relaxing immediately after being refreshed. A duty cycle light source can cause this relaxation effect to be seen as slightly discolored color bands on the display. This occurs much the same way a strobe light appears to cause a moving object to be non-moving. Because liquid crystals are formulated from a specially manufactured fluid or oil, the extent and speed of relaxing increases as the temperature is increased because the liquid viscosity is decreased. The display aliases become more pronounced as the liquid crystals heat up during normal use or when used in high temperature environments and the oil inside them becomes less viscous. The relationship between the light source and the display frequency can cause various artifacts. The artifacts include fixed color bars or fast or slowing moving bars. Moving colors bars can be caused by unlocked frequencies or locked frequencies where the relationship of frequencies causes the color bars to appear in a fixed pattern that is much lower than 60 Hz. For the purposes of this discussion, "unlocked" means that the frequencies can vary independently. "Locked" means the ratio of the frequencies stays constant even as they drift. The stated artifacts are caused by light sources that are used in duty cycle mode whether they are used in front light, backlight, edge light or any other mode. It should be noted that in the case of unlocked frequencies, either the light source or the display may not show problems at certain times and at other times, have very visible aritfacts. This suggests that a fixed frequency ratio is generally desirable.

A conventional solution to minimize the unwanted display aliases is increasing the display refresh frequency, so that the liquid crystals do not have enough time to completely degrade and so that the difference in color from the center of the color band to a point farthest away is much smaller. This method can greatly reduce the color bands. Care must be taken, as discussed below, when controlling the backlight frequency to minimize certain artifacts and to avoid others.

Another known solution to reduce visible display aliases in LCD displays is to increase the light source frequency while keeping the display refresh frequency at its original level. This reduces the display aliases on the display, but generally has the undesired consequence of reducing the backlight dimming ratio for light sources that have a minimum "on time." For example, doubling the backlight frequency cuts the available dimming ratio in half. This method reduces the visibility of the color bands by causing them to be in different parts of the display, thus, averaging the bands over the entire display.

Traditionally, backlights had limited dimming capabilities, resulting in dimming ratios of 20 to 1 or less. Recently, industry sought a need for greater dimming for these passive displays. As a result, methods were developed for creating greater dimming ratios for adjusting the illumination of backlights in passive LCD displays. In particular, a period of time is established during which the backlight may be turned on. This period is set long enough to provide a wide range of dimming. Dimming is accomplished when the backlight is on for a time less than the full period available. Dimming of backlights have improved to ratios greater than 500 to 1.

Although the prior art includes various methods and apparatuses that refresh liquid crystal displays, there exists a need for a liquid crystal display having a wide dimming range while reducing the effects of display aliases and beat frequency artifacts. The present invention fills these and other needs, and overcomes the short-comings of the prior art.

BRIEF SUMMARY OF THE INVENTION

It is an object of the invention to provide a method and apparatus for refreshing a liquid crystal display that allows for dimming of the display so that display aliases are reduced on the display.

It is also an object of this invention to provide a method and apparatus for refreshing a liquid crystal display that allows for dimming of the display so that visible beat frequency artifacts are minimized on the display.

To accomplish these and other related objects, the invention is directed to a method and apparatus for displaying data on a liquid crystal display. The apparatus consists of a central processing unit, a LCD display with an associated LCD controller, and a light source with an associated light source controller. Displaying data is accomplished by generating a backlight frequency via the backlight controller to a period long enough to allow for dimming of the display at ratios greater than 20 to 1. The LCD controller sends a display refresh frequency for reenergizing the pixels (liquid crystals) in the display. In accordance with the invention, the display refresh frequency and backlight frequency are set such that the ratio between them includes a fraction. Particularly, the stated ratio is preferably 6.5.

BRIEF DESCRIPTION OF THE DRAWINGS

These and other objectives and advantages of the present invention will be more readily apparent from the following detailed description of the drawings of the preferred embodiment of the invention, in which.

DETAILED DESCRIPTION OF THE INVENTION

Figure 1:
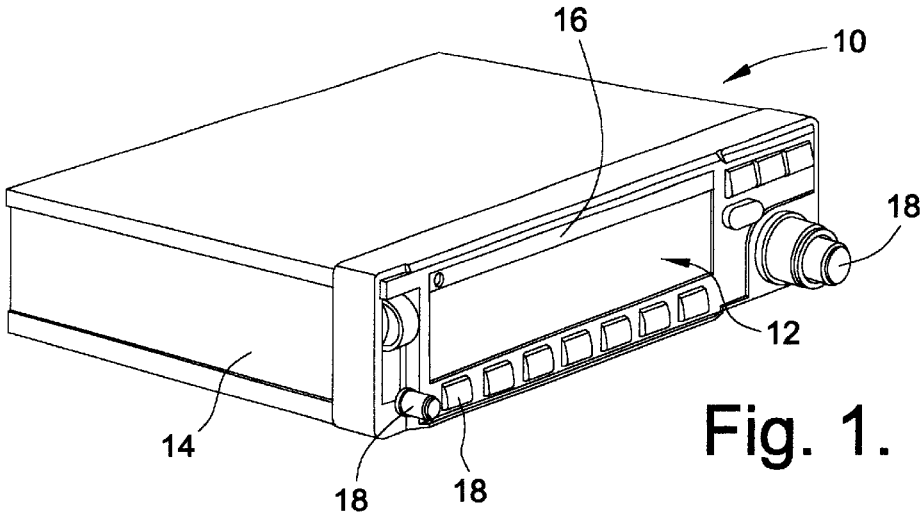
FIG. 1 is a perspective view of an electronic instrument, such as a panel mounted avionics device, equipped with a liquid crystal display in accordance with the present invention.

Turning now to the drawings in greater detail, and initially to FIG. 1, numeral 10 generally designates an instrument that is used in an avionics, marine or recreational application and that is equipped with a display generally designated by numeral 12. Preferably, display 12 is a liquid crystal display, but could be of other known types of displays. The instrument includes a generally rectangular cabinet or housing 14 having a front panel 16 on which the display 12 is located. The front panel 16 is also equipped with various controls 18 including buttons, knobs and the like that would be consistent with an electrical instrument having such a display.

Figure 2:
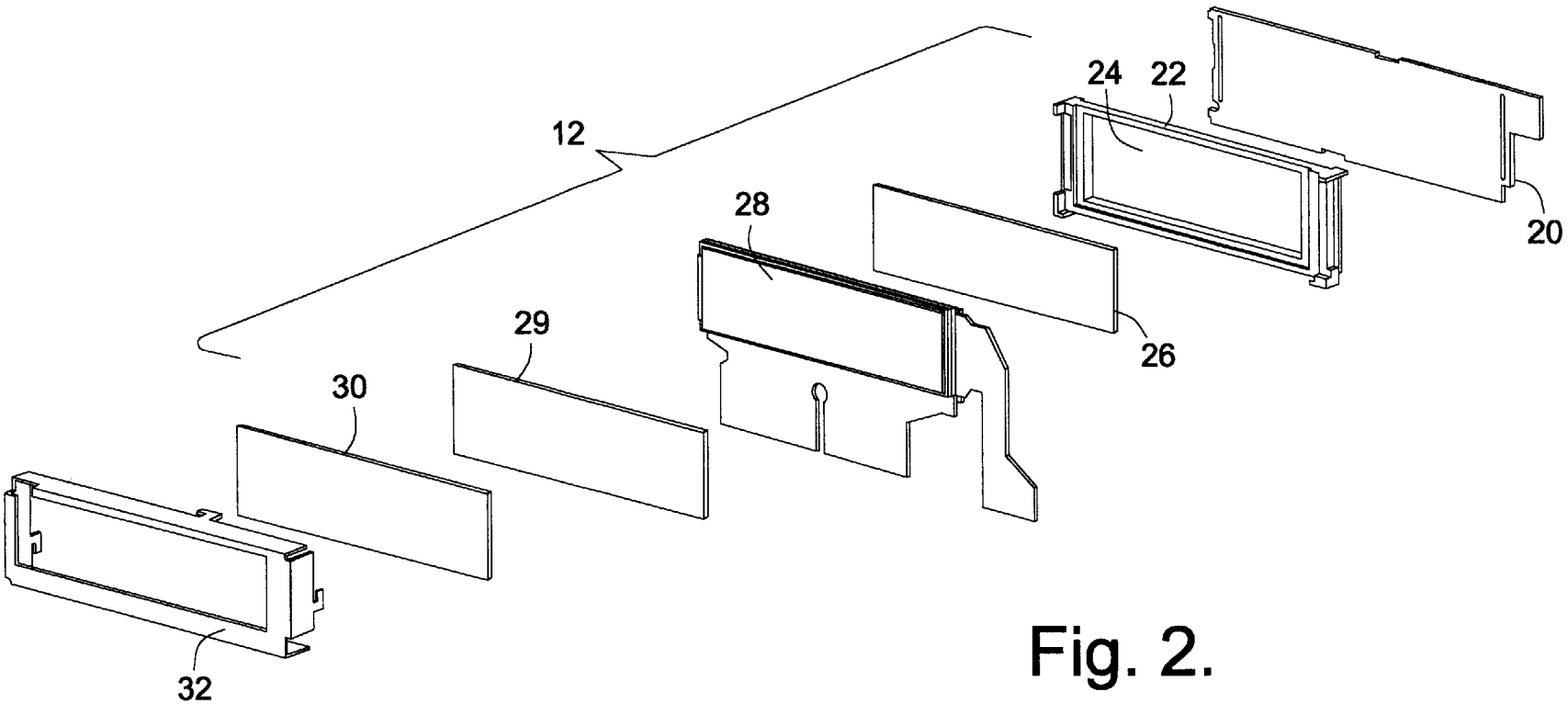
FIG. 2 is an exploded perspective view of the parts of the display.

The preferred physical construction of display 12 is best shown in FIG. 2. A printed circuit board 20 is connected with a light block or backlight 22 by means of a plurality of standard connections. The light block (backlight) 22 contains an array of light emitting diodes (LEDs) 24 which emit light when energized. Other known light sources such as cold cathode flourescent tubes could be utilized as a backlight 22. A special diffuser panel 26 is disposed on the front face of the LED backlight 22. The diffuser 26 is constructed such that it is able to transmit through it the light that is emitted by the backlight 22 and reflect a substantial portion of any ambient light that is incident on its front surface.

The display 12 also includes a liquid crystal display (LCD) module 28 that preferably takes the form of a transmissive or backlit double super twist nematic (DSTN) display. The LCD module 28 is connected with the board 20 through standard electrical connections and is controlled in a manner to be subsequently described. An anti-reflective lens 30 covers the front face of the color filter 29 and a suitable frame 32 is provided to connect the components illustrated in FIG. 2 together as a single unit that is installed in the cabinet or housing 14 of instrument 10. The components in FIG. 2 are constructed and shaped to be assembled together by crimping and twisting the various tabs and other parts as would be readily understood.

Figure 4:
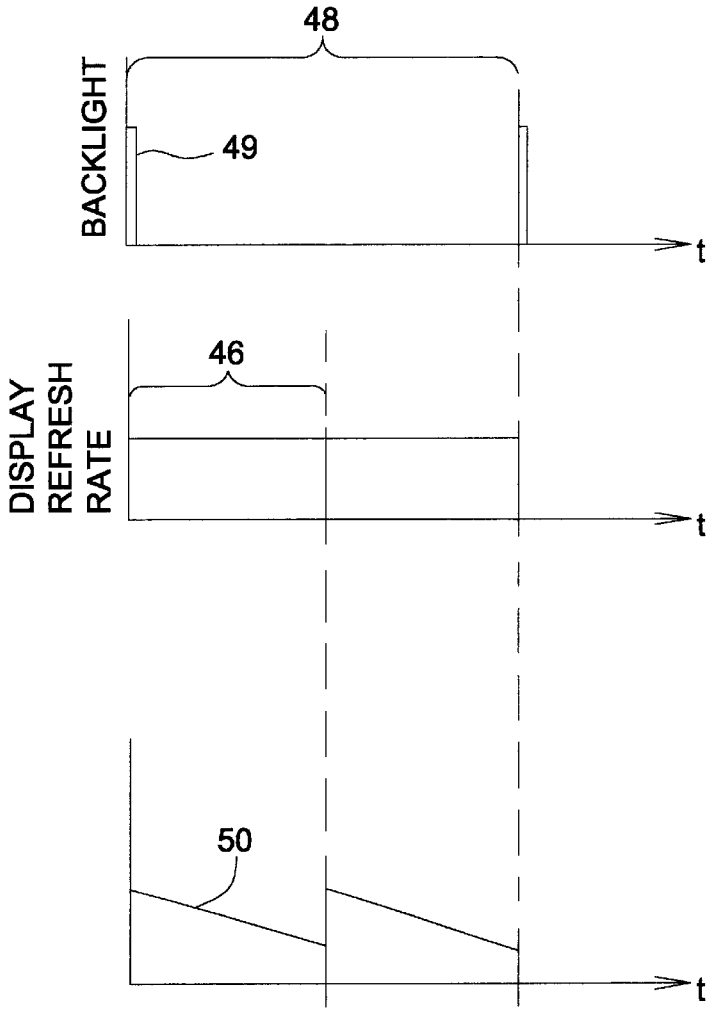
FIG. 4 is a graph representing the backlight frequency, display refresh frequency and liquid crystal relaxation rate as a function of time in a LCD display without the present invention.
Figure 3:
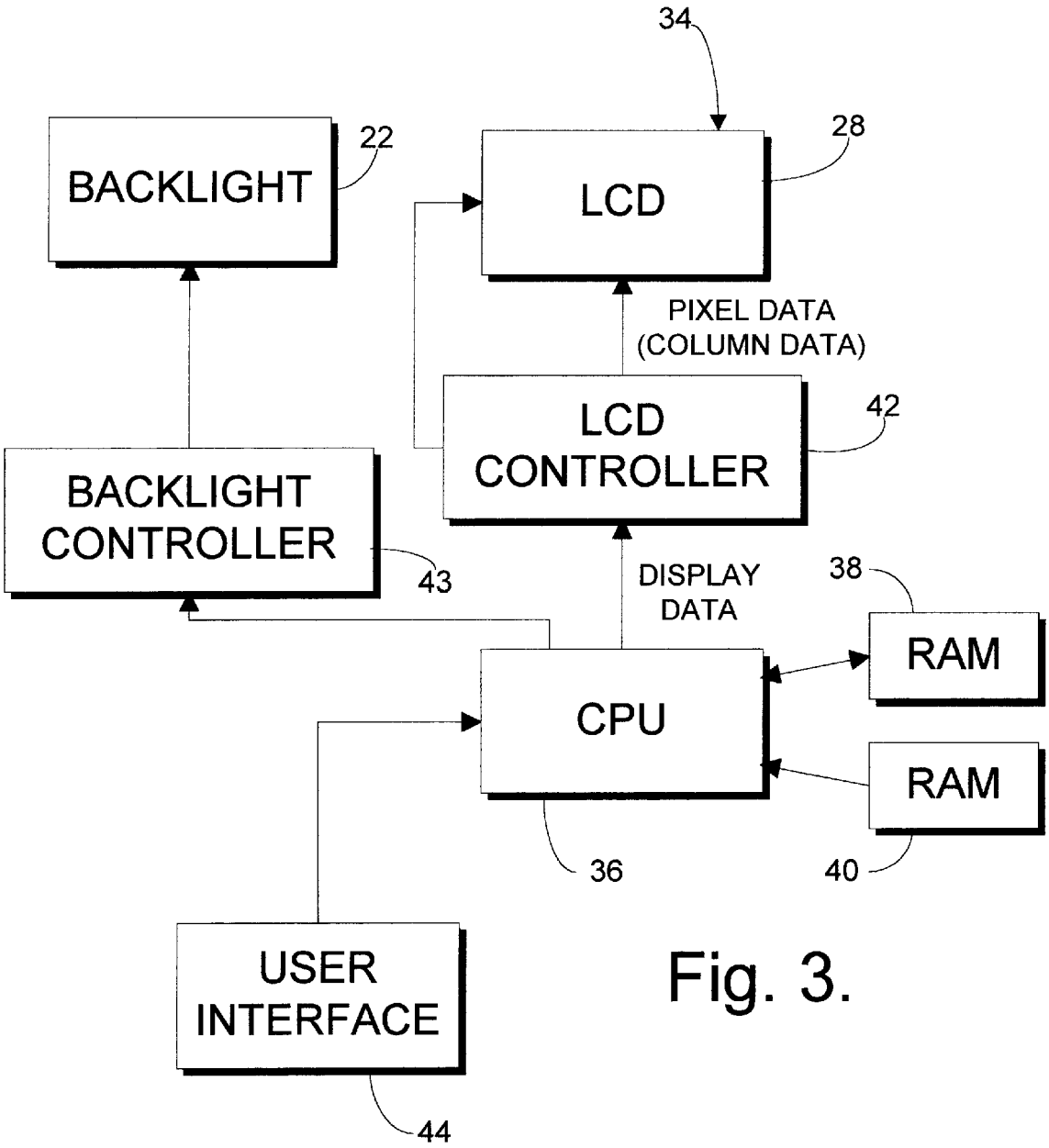
FIG. 3 is a functional block diagram of the principle electronic components used in the display of the present invention.
Figure 6:
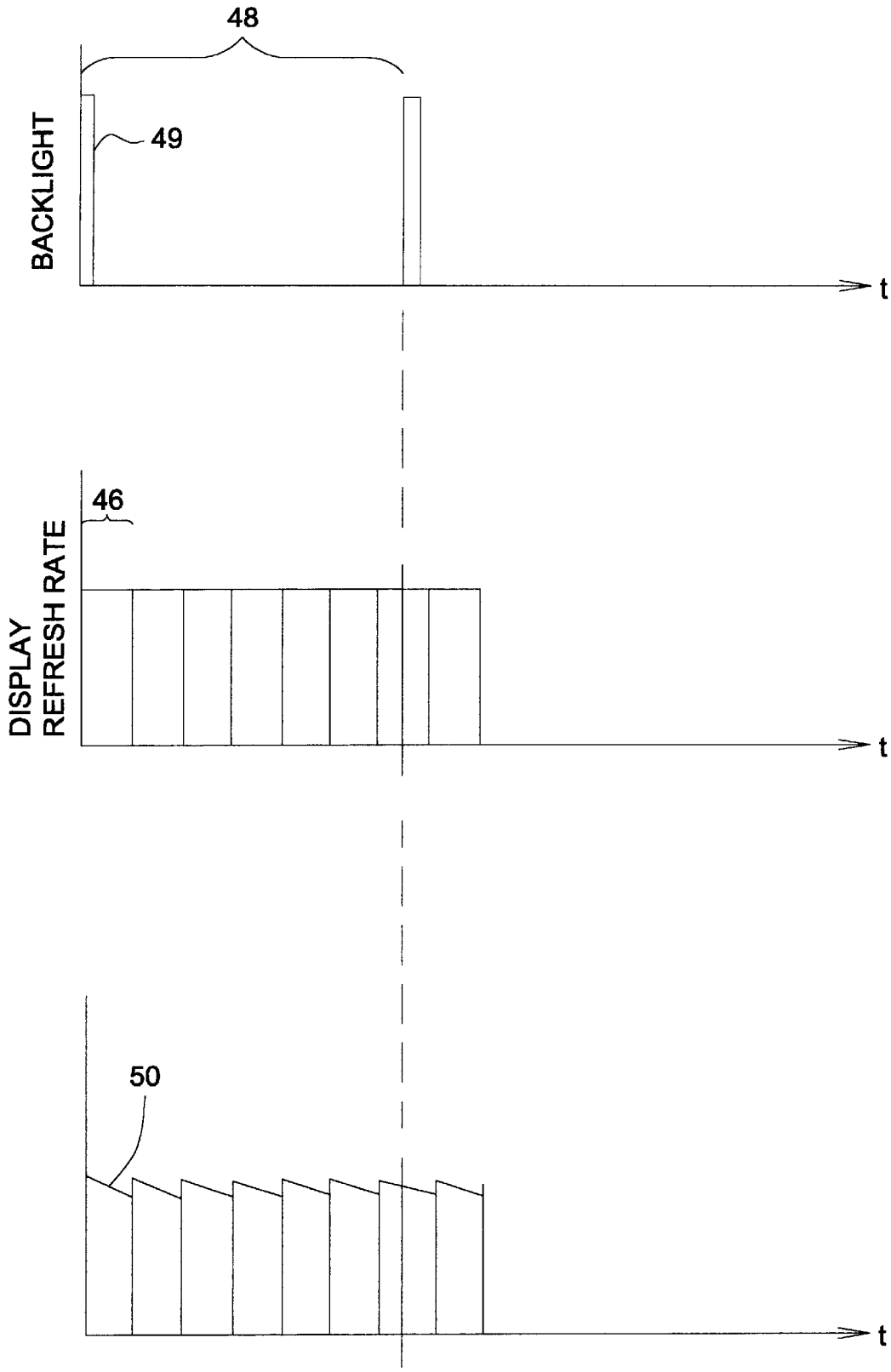
FIG. 6 is a graph representing the backlight frequency, display refresh frequency and liquid crystal relaxation rate as a function of time in accordance with the principles of the present invention.

The LCD module 28 is controlled by a system 34 as depicted in FIG. 3. A central processing unit (CPU) 36 is associated with a random access memory (RAM) 38 and a read only memory (ROM) 40. A LCD controller 42 actuates pixels (liquid crystals) of the LCD module 28 under the control of the CPU 36. One method for controlling and refreshing pixel and display data is disclosed in U.S. patent application Ser. No. 09/354,886 which is by incorporated by reference. In response to a signal from the CPU 36, a backlight controller 43 preferably generates a pulse width modulated signal 49 to activate the backlight 22 as illustrated in FIGS. 4 and 6. As would be understood, other methods for refreshing the LCD module 28 and generating the backlight signal exist and would be consistent with this invention. In accordance with the present invention, a user interface 44 receives operator input through traditional input devices such as knobs, dials, rheostats, photocells, and the like for adjusting the brightness of the backlight 22. The CPU 36 receives the input data and stores this information in the RAM 38. The system 34 also stores a preset display refresh frequency and the backlight frequency in ROM 40.

Figure 5:
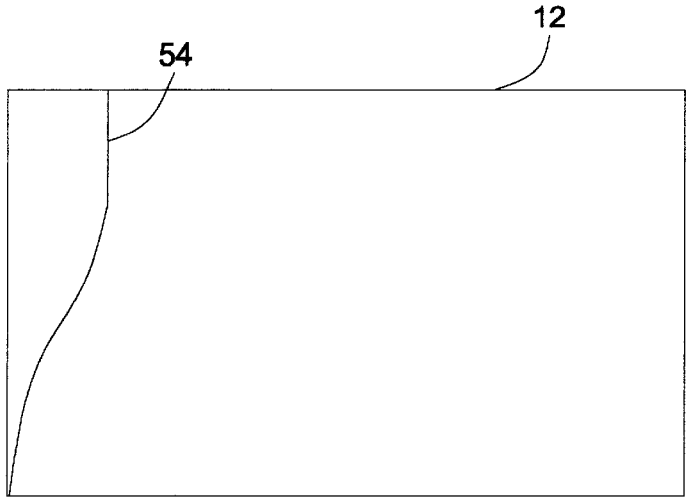
FIG. 5 is illustrative of a display alias present in an LCD display without the present invention.

When in use, the display 12 provides a visual display of data that may be numerals, letters, or other informational characters. Traditionally, the display refresh frequency 46 is set at approximately 140 Hz. and the backlight frequency 48 is set at approximately 70 Hz., as illustrated in FIG. 4. Design parameters such as pixel degradation 50 and power consumption are considered when determining a proper display refresh frequency setting. Pixel degradation 50 is illustrated in FIG. 4 where the pixel is fully charged at the moment it is turned on and immediately begins to dissipate or relax over time. In this case, a color band 54 appears as shown in FIG. 5 because the backlight is on at a time when the same pixels are being refreshed. Note that, in this case, this only occurs every other "frame" of display data because the display refresh frequency 46 equals twice the backlight frequency 48. However, all pixels are in exactly the same part of their refresh relax state when the backlight is on. This strobe effect causes color bands 54 associated with the pixel relaxation.

Figure 7:
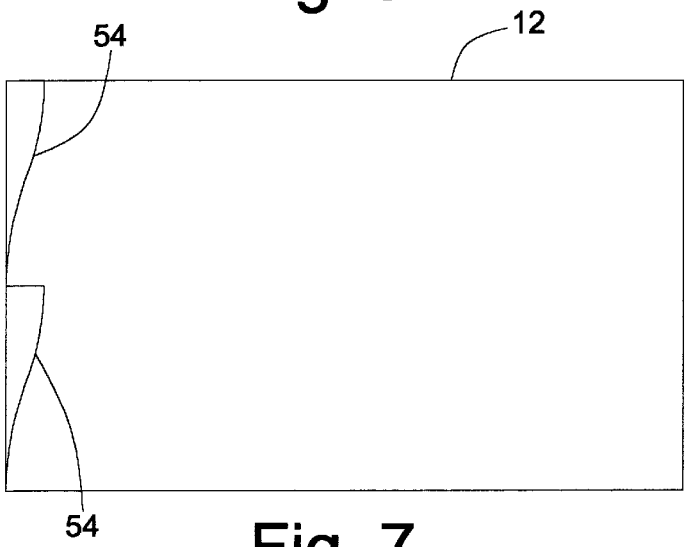
FIG. 7 is illustrative of a reduced display alias in accordance with the present invention.
Figure 8:
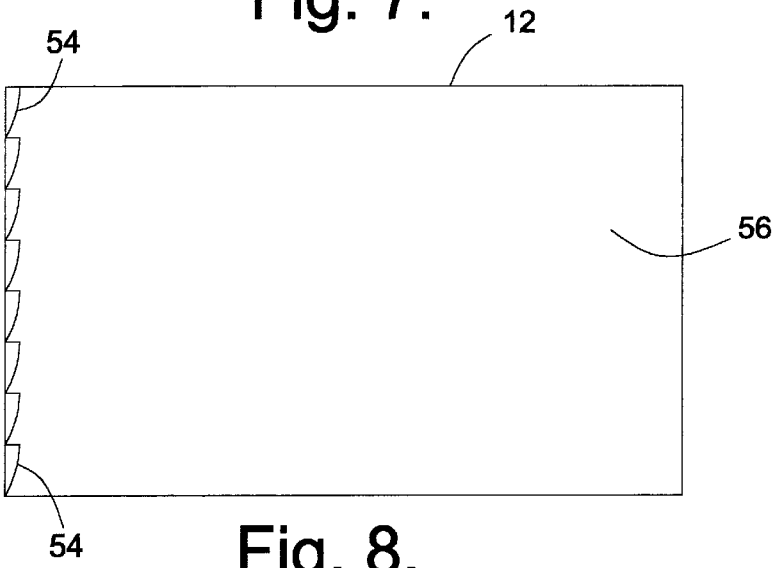
FIG. 8 is illustrative of further reduced display aliases, but having undesired beat frequency artifacts that are avoided by the present invention.

In a preferred embodiment, the display refresh frequency 46 is raised and set at approximately 455 Hz. while keeping the backlight frequency 48 set at approximately 70 Hz., thus creating a display refresh frequency to backlight frequency ratio of exactly 6.5. Small errors due to frequency drift or incorrectly choosing the frequencies can cause slowly moving, albeit reduced, artifacts. This movement tends to make the artifacts much more noticeable and therefore objectionable. As illustrated in FIG. 6, setting the display refresh frequency 46 at more than six times the backlight frequency 48 reduces the effects of pixel degradation 50 seen as display aliases 54 shown in FIG. 7. This is because the pixels have less time to relax before the next refresh. However, raising the display refresh frequency 46 alone without controlling the backlight frequency may produce unwanted beat frequency artifacts 56 that appear on the display as moving horizontal lines as illustrated in FIG. 8.

In a preferred embodiment, the beat frequency artifacts 56 can be removed by aligning the ratio of the display refresh rate frequency 46 and the backlight frequency 48 to a fraction of one-half while keeping both frequencies above 60 Hz. to prevent artifacts from appearing. FIG. 7 shows two reduced color band aliases 54 that result from the fraction being set at one-half. Increasing or decreasing the fraction has the positive effect of reducing the effects of the display aliases 54, but can increase the amount of unwanted beat frequency artifacts 56 seen on the screen depending on the frequency values involved. For example, as illustrated in FIG. 8, setting the fraction at 0.125 creates eight display aliases 54 that are significantly smaller than one display alias created when the fraction is set at zero as illustrated in FIG. 2. This reduction in display alias interference, however, has the consequence of producing beat frequency artifacts 56 as moving or flashing color lines visible to the user because the period of the eight color bars is much less than 60 Hz.

From the foregoing, it will be seen that this invention is one well adapted to attain all the ends and objects hereinabove set forth together with other advantages that are inherent to the structure.

It will be understood that certain features and subcombinations are of utility and may be employed without reference to other features and subcombinations. This is contemplated by and is within the scope of the claims.

What is claimed is:

1. A method of displaying data on a display comprised of liquid crystals, said method comprising:

providing a backlight having a backlight frequency;

refreshing liquid crystals of a display at a refresh rate;

setting said refresh rate to be greater than said backlight frequency, wherein at least one of said refresh rate and backlight frequency is greater than 60 Hz; and selecting a ratio between said backlight frequency and said refresh rate of said liquid crystals, wherein said ratio includes a fraction.

2. The method as set forth in claim 1, wherein said refresh rate is between 5.5 and 7.5 times greater than said backlight frequency.

3. The method as set forth in claim 1, wherein said refresh rate is approximately 6.5 times greater than said backlight frequency.

4. The method as set forth in claim 1, wherein said backlight has an associated dimming ratio, said method further comprising setting said dimming ratio to be greater than 20 to 1.

5. The method as set forth in claim 4, wherein said dimming ratio is greater than 100 to 1.

6. The method as set forth in claim 4, wherein said dimming ratio is greater than 300 to 1.

7. A method of displaying data on a display comprised of liquid crystals, said method comprising:

providing a backlight having a backlight frequency;

refreshing liquid crystals of a display at a refresh rate;

setting said refresh rate to be greater than said backlight frequency, wherein at least one of said refresh rate and backlight frequency is greater than 60 Hz;

setting a ratio between said refresh rate and said backlight frequency in order to set a fraction of said ratio to be one-half; and setting said refresh rate and said backlight frequency to each be above 60 Hz.

8. The method as set forth in claim 7, wherein said refresh rate is greater than said backlight frequency.

9. The method as set forth in claim 7, wherein said ratio is between 5.5 and 7.5.

10. The method as set forth in claim 7, wherein said backlight has an associated dimming ratio, said method further comprising establishing said dimming ratio to be greater than 20 to 1.

11. A method of displaying data on a passive display comprising liquid crystals, said method comprising:

providing a backlight having a backlight frequency;

refreshing liquid crystals of a display at a refresh rate, and setting said refresh rate greater than said backlight frequency, wherein at least one of said refresh rate and backlight frequency is greater than 60 Hz.

12. The method of claim 11, further comprising:

selecting a ratio between said backlight frequency and said refresh rate of said liquid crystals, wherein said ratio includes a fraction.

13. The method of claim 11, further comprising:

setting said refresh rate and said backlight frequency to each be above 60 Hz.

14. The method of claim 11, further comprising:

setting a ratio between said refresh rate and said backlight frequency in order to set a fraction of said ratio to be one-half.

15. A device comprising:

a passive display comprised of a plurality of liquid crystals;

a backlight for illuminating said passive display at a backlight frequency;

a controller for refreshing said liquid crystals of said passive display at a refresh frequency, wherein at least one of said refresh rate and backlight frequency is greater than 60 Hz, said controller setting a ratio between said backlight frequency and said refresh frequency to be a fraction, said controller setting said refresh frequency to be greater than said backlight frequency.

16. The device as set forth in claim 15, wherein said backlight is comprised of a plurality of light emitting diodes.

17. The device as set forth in claim 15, wherein said backlight is comprised of a cathode fluorescent tube.

18. The device as set forth in claim 15, wherein said backlight frequency is greater than 60 Hz.

19. The device as set forth in claim 15, wherein said backlight frequency is approximately 70 Hz.

20. The device as set forth in claim 15, wherein said refresh frequency to said backlight frequency ratio is 6.5.

21. The device as set forth in claim 15, wherein said fraction is one-half.

22. The device as set forth in claim 15, wherein said controller sets said fraction to one-half in order to reduce beat frequency artifacts.

23. The device as set forth in claim 15, wherein said device is a navigation device.

24. The device as set forth in claim 15, wherein said passive display is a color display.

25. The device as set forth in claim 15, wherein said controller sets said refresh frequency to minimize artifacts on said passive display.

26. The device as set forth in claim 15, wherein said controller sets said ratio to minimize artifacts on said passive display.

27. The device as set forth in claim 15, wherein said controller sets said fraction of said ratio to minimize artifacts on said display.

28. A device comprising:

a passive display comprised of a plurality of liquid crystals;

a backlight for illuminating said passive display at a backlight frequency;

a controller for refreshing said liquid crystals of said passive display at a refresh frequency, said controller setting said refresh frequency to be greater than said backlight frequency said controller setting a ratio between said backlight frequency and said refresh frequency to be one-half, said controller setting said refresh frequency and said backlight frequency to be greater than 60 Hz.

29. The device as set forth in claim 28, wherein said backlight frequency is approximately 70 Hz.

30. The device as set forth in claim 28, wherein said refresh frequency to said backlight frequency ratio is 6.5.

31. The device as set forth in claim 28, wherein said passive display is a DSTN display.

* * * * *